United States Patent [19]

Straitz, III et al.

[11] 3,960,064

[45] June 1, 1976

[54] TALL STACK CONSTRUCTION

[75] Inventors: John F. Straitz, III, Jenkintown; Hosein M. Shakiba, Philadelphia, both of Pa.

[73] Assignee: National Airoil Burner Company, Inc., Philadelphia, Pa.

[22] Filed: July 10, 1975

[21] Appl. No.: 594,749

[52] U.S. Cl. ..... 98/60; 23/283; 98/58; 110/184; 138/106; 138/107

[51] Int. Cl.[2] ..... E04H 12/20; E04H 12/28; F23J 11/12

[58] Field of Search ..... 23/283, 284; 52/648, 52/573; 110/184; 98/58, 60; 138/106, 107

[56] References Cited

UNITED STATES PATENTS

| | | | |
|---|---|---|---|
| 2,009,378 | 7/1935 | Bates | 23/283 |
| 3,233,567 | 2/1966 | Goldfield | 110/184 |
| 3,330,233 | 7/1967 | Clements | 110/184 |
| 3,368,319 | 2/1968 | Werner et al. | 52/648 |
| 3,368,506 | 2/1968 | Lawrence | 110/184 |
| 3,669,042 | 6/1972 | Lawrence | 110/184 |
| 3,727,566 | 4/1973 | Roy | 110/184 |
| 3,780,639 | 12/1973 | Wood | 110/184 |

FOREIGN PATENTS OR APPLICATIONS

| | | | |
|---|---|---|---|
| 4,416,514 | 3/1966 | Japan | 110/184 |

*Primary Examiner*—Morris O. Wolk
*Assistant Examiner*—Bradley R. Garris
*Attorney, Agent, or Firm*—Zachary T. Wobensmith, 2nd; Zachary T. Wobensmith, III

[57] ABSTRACT

A tall stack construction which may be used for the discharge of products of combustion or may be used as a flare stack with a burner at the top end for combustion of waste products from oil refineries or other chemical processes, the stack pipe being supported by a derrick in the form of a tripod with lateral support guy wires each extending over a pulley carried by one of the tripod legs and with their ends connected to a plate on the stack pipe. Additional stability is obtained by diagonal guy wires in tension extending from the bottom of the stack to the foundation in one embodiment. The stack pipe may be fixed to the derrick at the top or the bottom, may have a disentrainment drum at the bottom and may be supported in slidable engagement at the top of the derrick for expansion and for separation of the disentrainment drum.

12 Claims, 12 Drawing Figures

TALL STACK CONSTRUCTION

BACKGROUND OF THE INVENTION

1. Field of the Invention

This invention relates to and more stack construction and means particularly to a stack pipe and derrick support therefor.

2. Description of the Prior Art

It has been common practice with tall stacks such as are used with flare gas burners in oil refineries and the like to employ a derrick of a tripod construction between the legs of which the stack is supported. In such structures it is common practice also to connect the tripod legs to the stack between the top and the bottom by braces which are rigidly held at their outer ends by the tripod legs and are slidably connected to the stack at their inner ends.

One tripod derrick which has been proposed is shown in the U.S. Pat. No. 3,233,567, to Goldfield.

In the U.S. Pat. No. to Bates, 2,009,378, a stack of ceramic material is shown in which individual sections of the stack are supported by counterbalancing utilizing cables extending over pulleys carried by a skeleton framework so that should breakage of one section occur the sections supported above it will not fall, and the sections can be individually replaced.

None of the tall stack structures heretofore proposed has proven wholly satisfactory both from the viewpoint of installation and maintenance.

SUMMARY OF THE INVENTION

In accordance with the invention tall stack constructions are provided wherein the stack pipe is supported by a tripod derrick with spaced supports intermediate the top and bottom comprising lateral support guy wires each extending over a pulley carried by one of the tripod legs, with their ends connected to a plate fastened to the stack pipe. The stack pipe can be rigidly supported with respect to the tripod at the top or at the bottom, as desired, with a slidable connection at or near the other end to accommodate expansion and contraction attendant upon change of temperature. Support wires may extend from the bottom of the stack pipe to the foundation. The pipe may rest on a disentrainment drum, removably connected if desired.

The principal object of the invention is to provide tall stack construction wherein the stack pipe may expand upwardly or downwardly in response to thermal expansion and contraction while being supported and without causing damage to the derrick.

A further object of the invention is to provide, in a tall stack construction, a simple but effective bracing employing cables connected to plates secured to the stack and extending around pulleys carried by the legs of the derrick.

A further object of the invention is to provide tall stack construction utilizing a disentrainment drum wherein the stack pipe may be lifted to replace the disentrainment drum by apparatus carried on the top of the derrick.

A further object of the invention is to provide a tall stack construction wherein a work platform may be provided at the top of the derrick.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof, in which.

Figure 1:
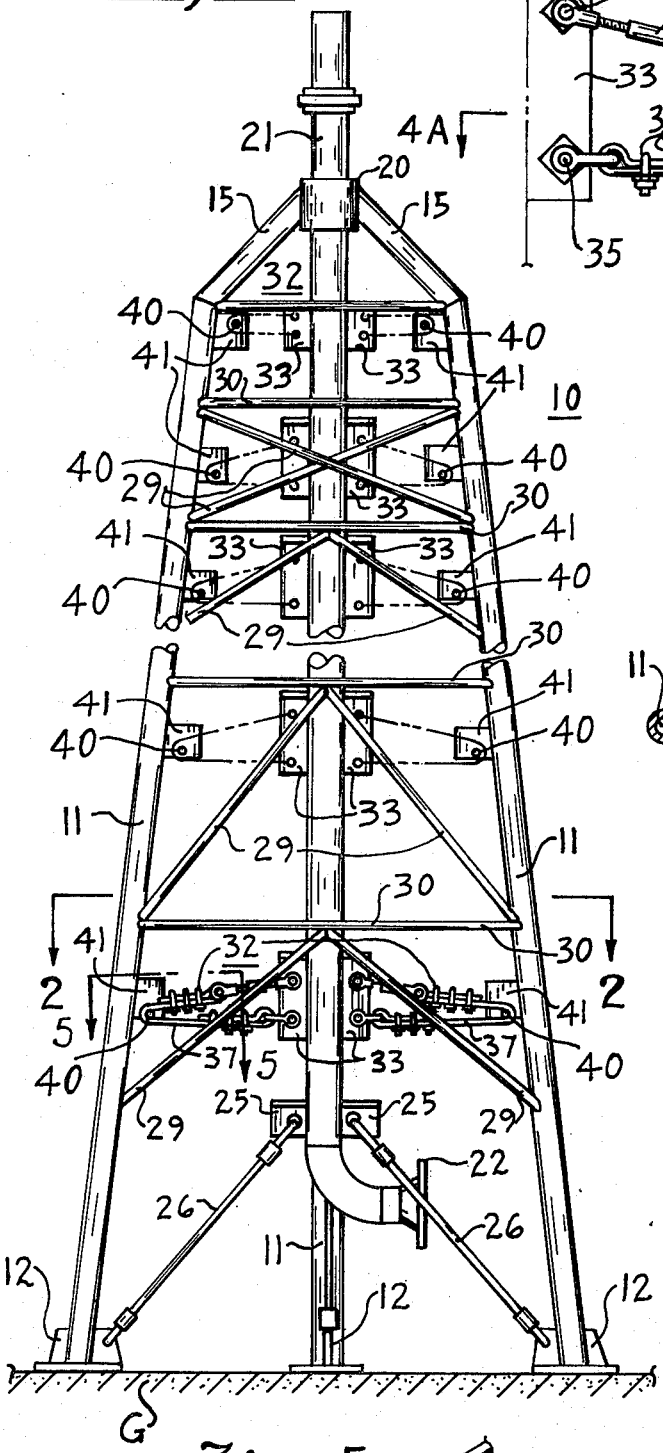
FIG. 1 is a side elevational view of one embodiment of a tall stack construction in accordance with the invention.
Figure 3:
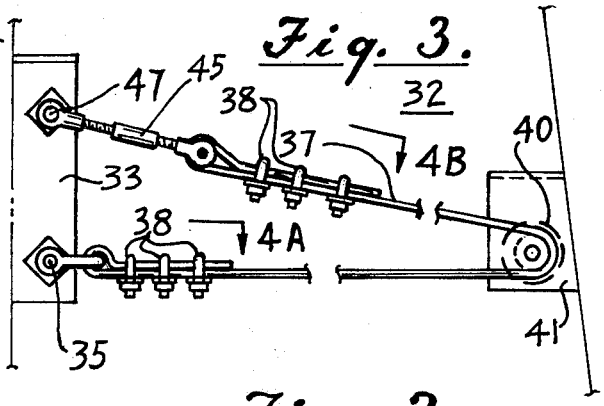
FIG. 3 is a sectional view, enlarged, taken approximately on the line 3—3 of FIG. 2.
Figure 2:
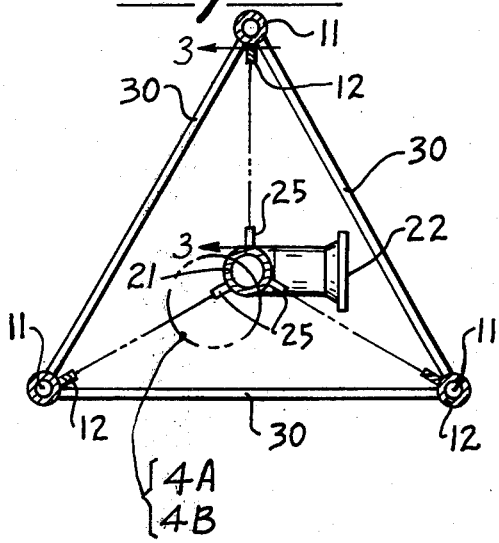
FIG. 2 is a horizontal sectional view taken approximately on the line 2—2 of FIG. 1.

It should, of course be understood that the description and drawings herein are illustrative merely and that various modifications and changes can be made in the structure disclosed without departing from the spirit of the invention.

DESCRIPTION OF THE PREFERRED EMBODIMENTS

Referring now more particularly to the drawings and FIGS. 1 to 5, inclusive, one embodiment of the tall stack construction is illustrated which includes a tripod 10 composed of three legs 11 rigidly secured at their bottom ends to foundation plates 12 which are secured by any suitable means to the ground G.

The legs 11 are preferably fabricated of hollow steel tubing, extend upwardly and converge inwardly with upper converging connecting members 15 secured to the legs 11 and to a collar 20 to which the stack pipe 21 is secured.

The stack pipe 21 may be utilized to carry waste products upwardly for dispersal or be provided with a burner tip (not shown) for combustion of waste products in a well known manner.

The pipe 21, at the bottom has a flange 22 thereon for connection to a source (not shown) of waste products to be delivered by the pipe 21. Adjacent the flange 22 and for each of the legs 11 plates 25 are secured to the pipe 21 each of which has a guy wire 26 attached thereto and to the foundation plates 12, exerting a vertical downward force on the pipe 21 and restraining it from sidewise movement.

Above the plates 25, the tripod legs 11 are connected together by horizontal brace members 30 which aid in establishing the rigidity of the tripod 10.

Diagonal brace members 29 are also preferably provided for strength and for rigidity.

Figure 4A:
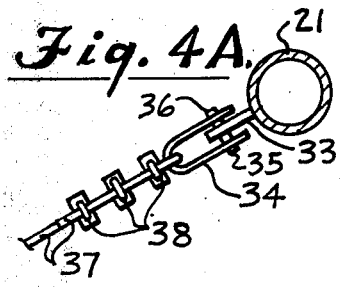
FIG. 4A is a fragmentary horizontal sectional view, enlarged, taken at the location 4A on FIGS. 2 and 3.
Figure 4B:
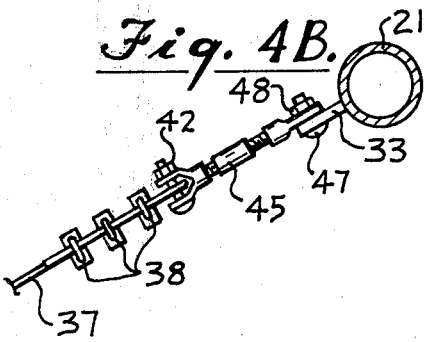
FIG. 4B is a fragmentary sectional view, enlarged, taken at the location 4B on FIGS. 2 and 3.
Figure 5:
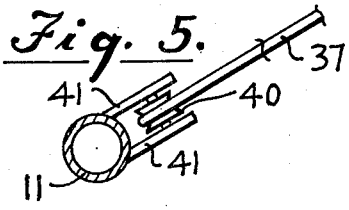
FIG. 5 is a fragmentary sectional view, enlarged, taken approximately on the line 5—5 of FIG. 1.

Above the plates 25 a plurality of support assemblies 32 are provided each with three plates 33 rigidly secured to stack pipe 21, such as by welding. Adjacent the upper ends of plates 33 as seen in FIG. 1 and 4A, U-shaped clips 34 are provided retained in pivotal engagement with the plates 33 by pins 35 and cotter pins 36.

The clips 34 each has one end of a guy wire 37 attached thereto by retainers 38 of well known type with the guy wires 37 passing over pulleys 40 which are pivotally engaged with plates 41 carried on the tripod legs 11.

The guy wires 37 are secured at the ends opposite to clips 34 to bolts 42, of adjustable turn buckles 45 and retained thereto by retainers 38 of well known type. The turn buckles 45 are adjustable to provide tension on the guy wires 37 which turn buckles 45 are secured to the plates 33 above pins 35 by bolts 47 and nuts 48.

The support assemblies 32 by reason of the tension placed on guy wires 37 exert a restraining force on the pipe 21 permitting limited vertical expansion and contraction of the stack pipe 21 without substantially altering the restraining effect of the guy wires 37.

Figure 6:
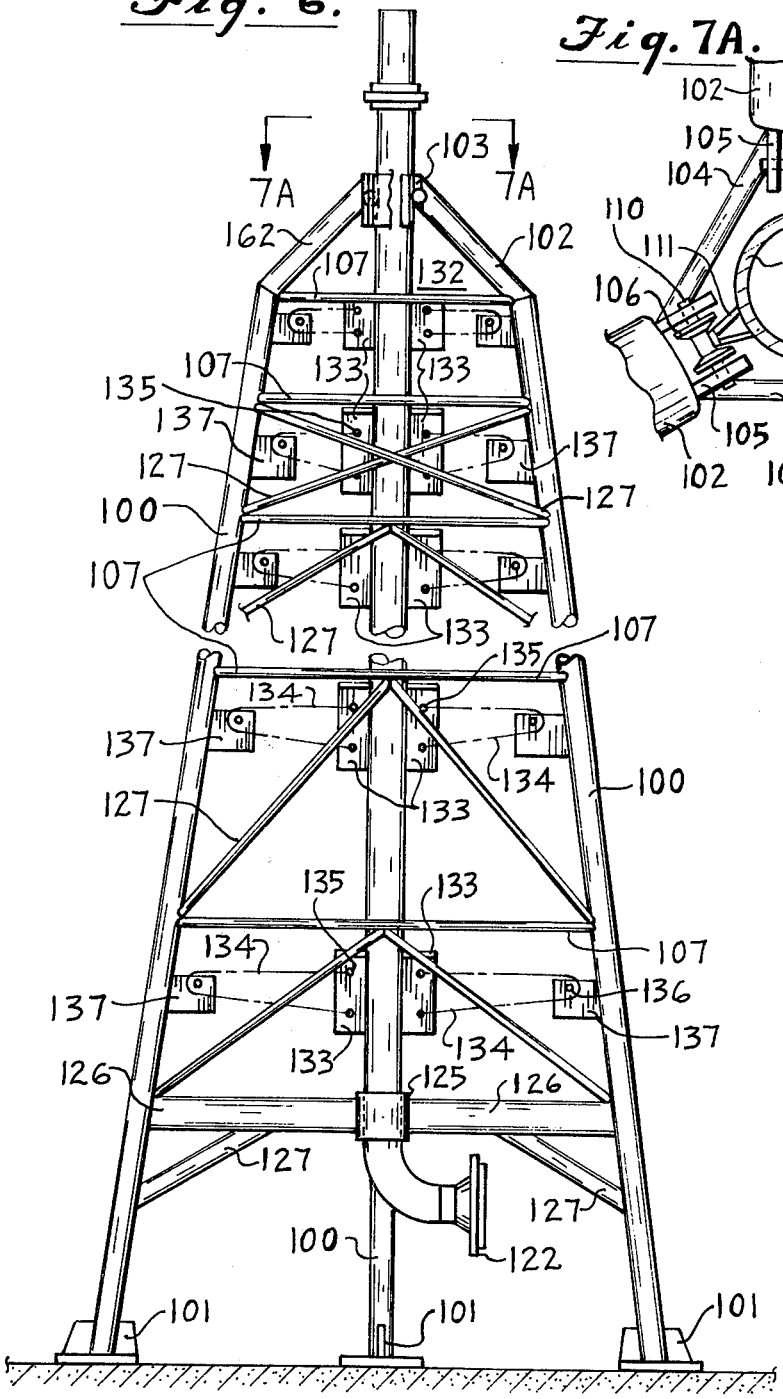
FIG. 6 is a view similar to FIG. 1 but illustrating another embodiment of the invention.
Figure 7A:
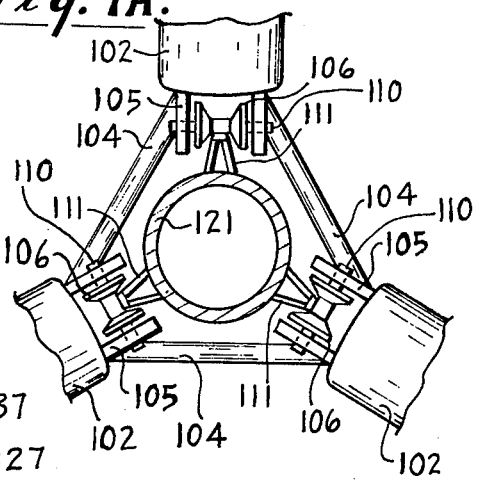
FIG. 7A is a horizontal sectional view, enlarged, taken approximately on the line 7A—7A of FIG. 6.

Referring now more particularly to FIGS. 6 and 7A of the drawings, another embodiment of the tall stack construction is illustrated which includes tripod legs 110 rigidly secured to foundation plates 101 which are attached to the ground G and have members 107 connecting the legs 100. The tripod legs 100 extend upwardly, converge inwardly and have angularly inwardly extending connecting members 102 connected thereto and to a triangular frame 103 which frame includes three angle members 104 secured together at their ends with pairs of plates 105 attached thereto at the intersections of the members 104. The plates 105 have spools 106 rotatably mounted therebetween by pins 110. The spools 106 are engaged with V-shaped plates 111 rigidly secured to a stack pipe 121, permitting vertical sliding engagement of pipe 121 but retaining the pipe 121 from sidewise movement. The stack pipe 121 is similar to pipe 21 in construction at the bottom, is provided with a flange 122 for connection to a source (not shown) of waste products to be burned above or merely discharged through pipe 121 for dispersal. Above the flange 122 the pipe 121 is retained in a collar 125 to which it is rigidly connected. The collar 125 has three arms 126 connected thereto and to the tripod legs 100 with additional diagonal bracing members 127 connected to the arms 126 and legs 100 for support of the arms 126. The collar 125 restrains the pipe 121 from sidewise movement and provides a support for the pipe 121.

Figure 7B:
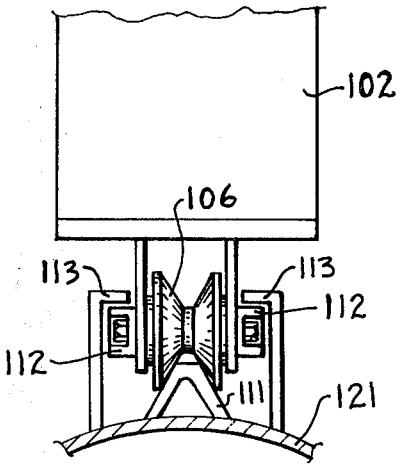
FIG. 7B is a view similar to FIG. 7A showing another form of mounting.

In FIG. 7B another form of guide and support for the stack pipe 121 is shown in which, in addition to the V-shaped plates 111 and the spools 106 movable therealong, the shaft 105 carries additional rollers 112 which engage with angle plates 113 secured to the stack pipe 121. The plates 113 have flanges engaged by the rollers 112 to restrain the stack pipe 121 against radial displacement.

Above the collar 125 the pipe 121 has a plurality of support assemblies 132 engaged therewith similar to the assemblies 32 each of which includes three plates 133 secured to the pipe 121 at spaced locations therearound. Each of the plates 133 adjacent its top has one end of a guy wire 134 fastened thereto by bolt 135 with the cable passing over a pulley 136 rotatably mounted to a plate 137 which is secured to one of the tripod legs 100. The guy wire 134 at its end opposite to bolt 135 is secured to the plate 133 and provided with turn buckles (not shown) similar to turn buckles 45 to permit detachment of the guy wires 134 and adjustment of the tension on wires 134.

Figure 8:
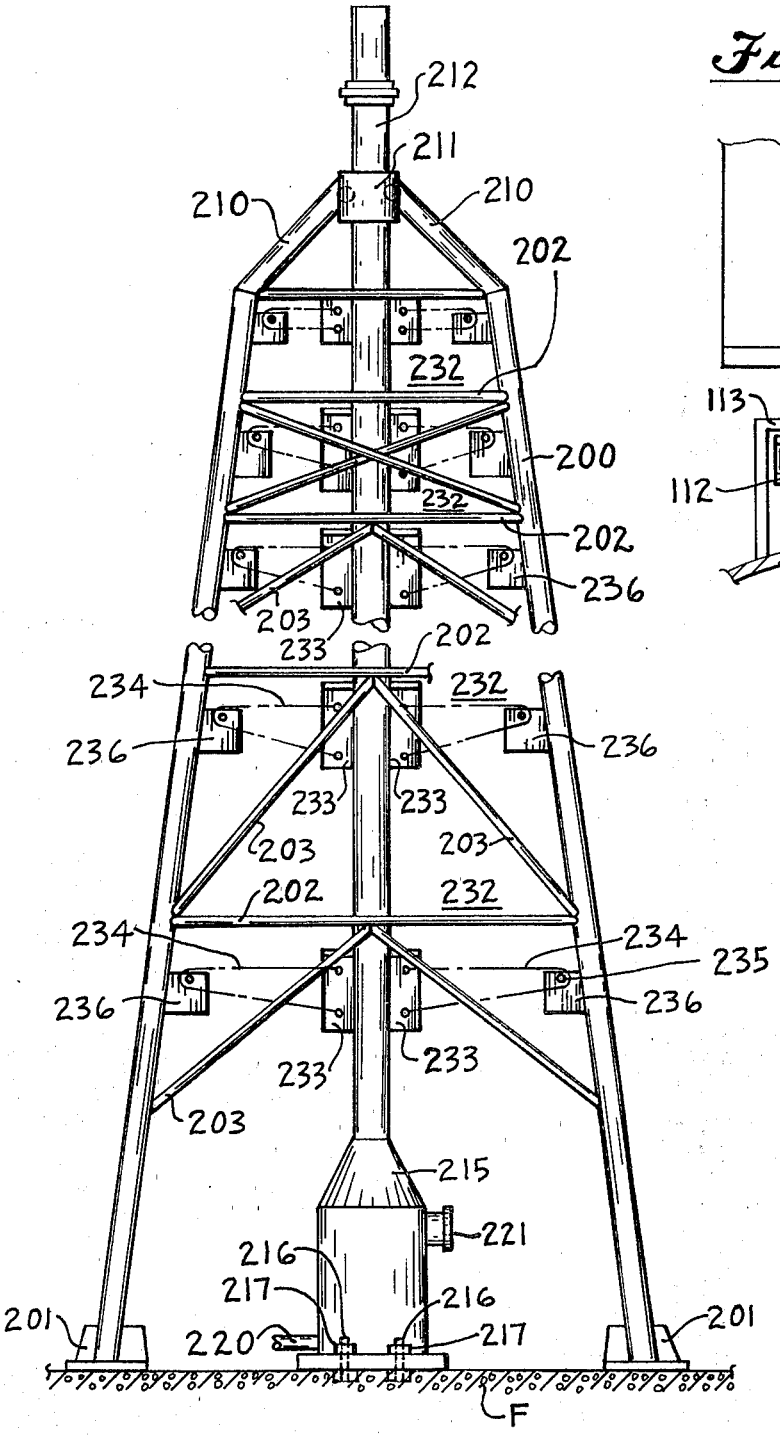
FIG. 8 is a view similar to FIG. 1 but illlustrating still another embodiment of the invention.

Referring now to FIG. 8 of the drawings, another embodiment of the tall stack construction is illustrated which includes tripod legs 200 rigidly secured to foundation plates 201 which are secured to the foundation F in any suitable manner. The tripod legs 200 are held in assembled relation by horizontal brace members 202 which are connected at their ends to the legs 200, diagonal stiffeners 203 also being provided as in the tripods previously described.

The legs 200 extend upwardly, converge inwardly and have angularly related connecting members 210 connected thereto at their upper ends which in turn are connected to a triangular frame 211 similar to frame 103 of FIGS. 6 and 7 which frame 211 has plates (not shown) and spools (not shown) which engage V-shaped plates (not shown) which are secured to a stack pipe 212.

The stack pipe 212 of conventional type is connected at its lower end to a disentrainment drum 215 of conventional type to provide for separation of slugs, water vapor and other heavy particles which settle out from the waste products to be discharged from stack pipe 212.

The drum 215 is detachably connected to foundation F by bolts 216 and nuts 217.

The drum 215 is provided with a drain connection 220 at its bottom to permit removal of the material which separates from the waste products passing through the drum 215.

A flange 221 is connected to the side of drum 215 for connection to a source of waste products (not shown) to be discharged from pipe 212.

Above the drum 215 a plurality of support assemblies 232 are provided similar to assemblies 32 and 132 with plates 233 connected to the pipe 212 and with guy wires 234 connected to the top and bottom of the plates 233 in the manner described for assemblies 32 and 132. The guy wires 234 are carried on pullyes 235 rotatably mounted to plates 236 which are fastened to the tripod legs 200 and which guy wires have turn buckle assemblies (not shown) attached thereto similar to assemblies 45 to provide tension on guy wires 234 for restraining sidewise movement of the stack pipe 212.

Figure 9:
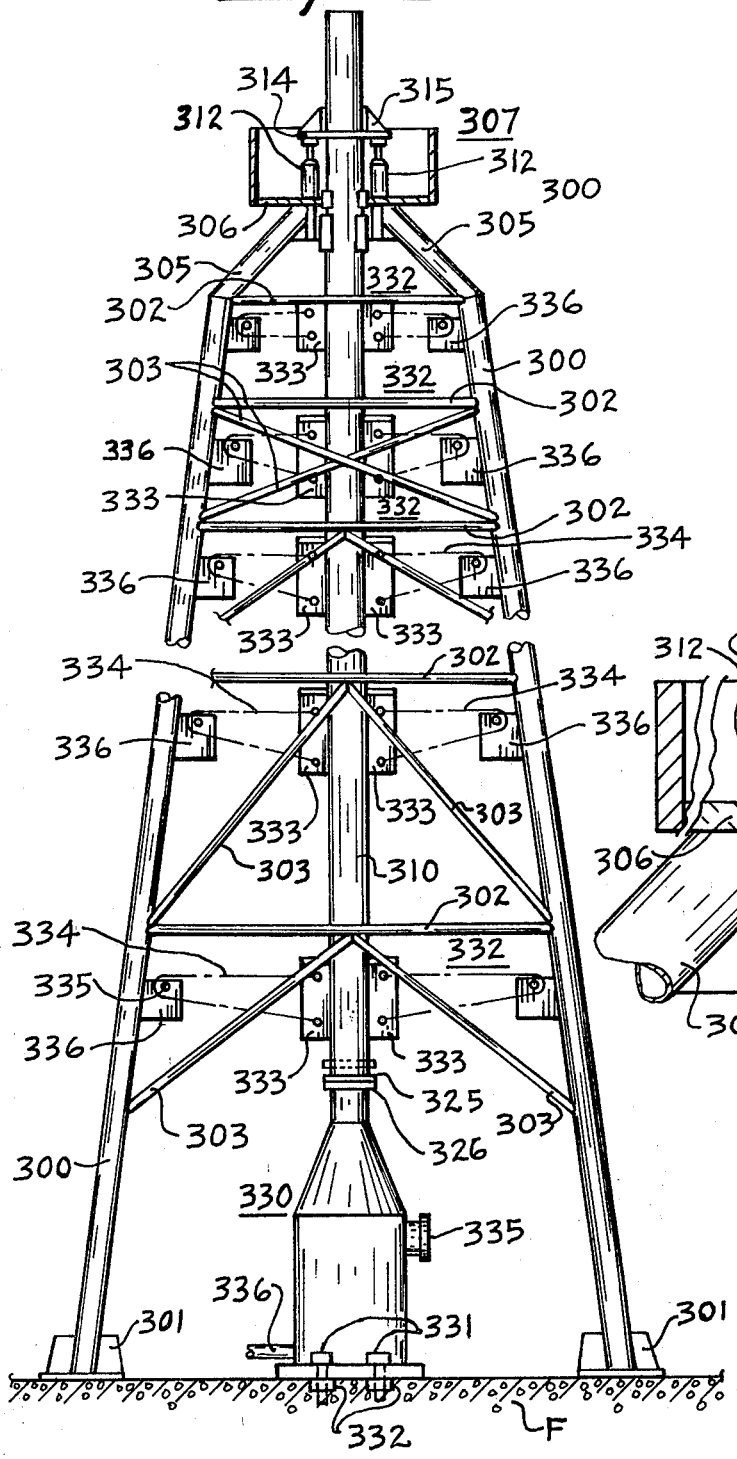
FIG. 9 is a view similar to FIG. 1 but illustrating still another embodiment of the invention.
Figure 10:
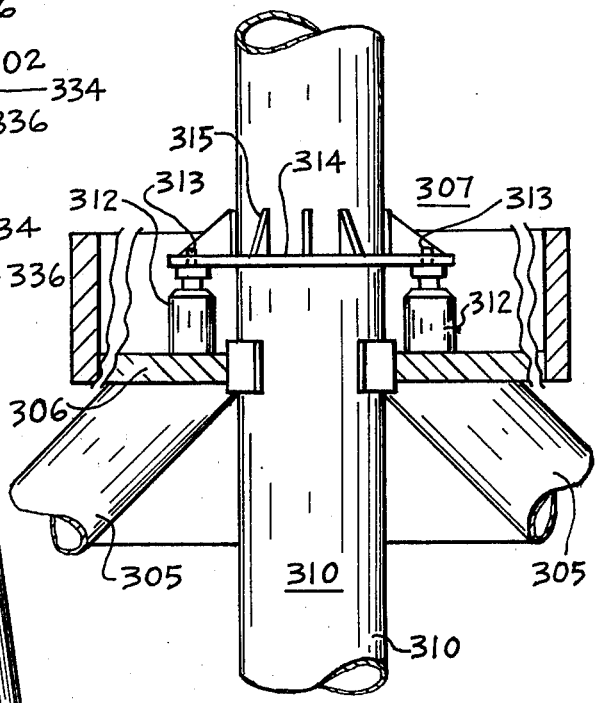
FIG. 10 is a fragmentary view, enlarged, in partial section, of a portion of the structure illustrated in FIG. 9.

Referring now to FIGS. 9 and 10, still another embodiment of the tall stack construction is illustrated which includes tripod legs 300 rigidly secured to foundation plates 301 which are fastened to the foundation F in a conventional manner.

The legs 300 are held together in the tripod arrangement by a plurality of horizontal connecting members 302 which are secured at their ends to the legs 300 and with diagonal braces 303. The legs 300 extend uwpardly, converge inwardly and have angularly related connecting members 305 connected thereto and to the jacking plate 306 of a work platform 307. The jacking plate 206 extends around and retains a stack pipe 310 therein in vertical slidable engagement with a mounting similar to that shown in FIGS. 6, and 7A or 7B.

The jacking plate 306 has a plurality of hydraulic jacks 312 thereon with centering pins 313 which can be engaged with a plate 314 welded to the pipe 310 which plate 314 has reinforcement plates 315 welded to it and to the pipe 310.

The jacks 312 preferably operated together from a single pressure source, are utilized to raise the pipe 310 for purposes to be described.

The stack pipe 310 which is of conventional type has a flange 325 at its bottom end which is normally engaged with a flange 326 of a disentrainment drums 330.

The drum 330, which can be of conventional type can be secured to the ground or foundation F by a plurality of bolts 331 which extend downwardly into engagement with nuts 332 anchored below the surface of the ground thus permitting the sidewise movement of the drum 330 without obstacles.

The drum 330 is similar to drum 215 and is provided with a flange 335 connected to a source of waste products (not shown) to be discharged therefrom through the pipe 310.

The drum 330 is provided with a drain 336 to permit removal of material such as slugs and water from the waste products that settle out in the drum 330.

When it is desired to remove the drum 330, the flanges 325 and 326 are disconnected and the pipe 310 is raised by the hydraulic jacks 312 and plate 314. Another drum 330 can be provided and the flanges 325 and 326 can be reconnected when the pipe 310 is lowered.

The pipe 310 above the flange 325 is provided with a plurality of support assemblies 332 similar to support assemblies 32, 132 and 232 and which each includes three plates 333 welded to the pipe 310, cables 334 attached to the top and bottom of the plates 333 extending over pulleys 335 rotatably mounted on plates 336 carried by the tripod legs 330, with turn buckles (not shown) as previously described.

It will thus be seen that structure is provided with which the objects of the invention are acheived.

We claim:

1. A vertical discharge stack assembly for dispersal of gaseous products which comprises a vertical stack pipe, a derrick for supporting said pipe and having at least three legs, rigid supporting means for vertically supporting said stack pipe at a predetermined location along its length in fixed relation to said derrick, and flexible restraining means interposed in connecting relation between said derrick and said stack pipe for restraining horizontal movement of said stack pipe, said restraining means including mounting members secured to said stack pipe and to one of said derrick legs at predetermined elevations, and a substantially u-shaped, flexible guy wire having substantially horizontally extending portions, the free ends of which are attached to one of said mounting members while the looped end of said guy wire is attached to the other of said mounting members.

2. A vertical discharge stack assembly as defined in claim 1 in which said stack pipe is rigidly secured to said derrick at the top.

3. A vertical discharge stack assembly as defined in claim 1 in which said stack pipe is in rigidly secured relation to said derrick at the bottom.

4. A vertical discharge stack assembly as defined in claim 1 in which diagonal guy wires are attached to plates carried on said stack pipe at the bottom and to said derrick.

5. A vertical discharge stack assembly as defined in claim 1 in which the looped end of said guy wire passes over a pulley attached to the other of said mounting members.

6. A vertical discharge stack assembly as defined in claim 5 in which said pulley is attached to said mounting member on said leg.

7. A vertical discharge stack assembly as defined in claim 1 in which said stack pipe is in slidable engagement with a portion of said derrick.

8. A vertical discharge stack assembly as defined in claim 7 in which said stack pipe is in slidable engagement at the top of the derrick.

9. A vertical discharge stack assembly as defined in claim 1 in which the means for supporting said stack pipe is at the bottom and comprises a disentrainment drum.

10. A vertical discharge stack assembly as defined in claim 9 in which a detachable connection is provided between said stack pipe and said disentrainment drum.

11. A vertical discharge stack assembly as defined in claim 10 in which members are provided at the top of the derrick for lifting said pipe with respect to said drum.

12. A vertical discharge stack assembly as defined in claim 11 in which said lifting members comprise jacks.

* * * * *

UNITED STATES PATENT OFFICE

CERTIFICATE OF CORRECTION

Patent No. 3,960,064 Dated June 1, 1976

Inventor(s) John F. Straitz, III and Hosein M. Shakiba

It is certified that error appears in the above-identified patent and that said Letters Patent are hereby corrected as shown below:

Column 3

Line 27, before "rigidly" "110" should be - 100 -

Column 4

Lines 59 and 60, "uw-pardly" should be -up-wardly -

Column 5

Line 8, after "disentrainment" "drums" should be - drum -

Line 35, after "legs" "330" should be - 300 -

Signed and Sealed this

Tenth Day of August 1976

[SEAL]

*Attest:*

RUTH C. MASON
*Attesting Officer*

C. MARSHALL DANN
*Commissioner of Patents and Trademarks*